US009158284B1

(12) United States Patent
Crettex

(10) Patent No.: US 9,158,284 B1
(45) Date of Patent: Oct. 13, 2015

(54) ON-DEMAND DISPLAY DEVICE

(71) Applicant: Frederic Crettex, Prangins (CH)

(72) Inventor: Frederic Crettex, Prangins (CH)

(73) Assignee: LA MONTRE HERMES SA, Brugg BE (CH)

( * ) Notice: Subject to any disclaimer, the term of this patent is extended or adjusted under 35 U.S.C. 154(b) by 0 days.

(21) Appl. No.: 14/333,642

(22) Filed: Jul. 17, 2014

(30) Foreign Application Priority Data

May 26, 2014 (CH) ..... 802/14

(51) Int. Cl.

| | |
|---|---|
| ***G04B 19/02*** | (2006.01) |
| ***G04B 19/04*** | (2006.01) |
| ***G04B 19/20*** | (2006.01) |
| ***G04G 9/00*** | (2006.01) |

(52) U.S. Cl.
CPC ..... *G04B 19/202* (2013.01); *G04B 19/02* (2013.01); *G04G 9/0076* (2013.01); *G04B 19/04* (2013.01)

(58) Field of Classification Search
CPC ..... G04B 9/0076; G04B 19/02; G04B 19/04; G04B 19/202; G04G 9/0076
USPC ..... 368/80, 220, 223
See application file for complete search history.

(56) References Cited

U.S. PATENT DOCUMENTS

| | | | | |
|---|---|---|---|---|
| 426,396 | A * | 4/1890 | Schlatter | 368/102 |
| 7,130,247 | B2 * | 10/2006 | Brida et al. | 368/110 |
| 8,432,772 | B2 * | 4/2013 | Meis | 368/71 |
| 2008/0151698 | A1 * | 6/2008 | Gil et al. | 368/18 |
| 2013/0182543 | A1 * | 7/2013 | Crettex | 368/220 |

FOREIGN PATENT DOCUMENTS

| | | |
|---|---|---|
| WO | 2012/042448 | 4/2012 |

* cited by examiner

*Primary Examiner* — Vit W Miska
(74) *Attorney, Agent, or Firm* — Young & Thompson

(57) ABSTRACT

Display device for a timepiece includes: a first indication organ kinematically linked to a wheel rotatable by a timepiece movement; a second indication organ, coaxial to the first indication organ; a control device including a control organ to be activated by a user; the device arranged to drive the indication organs in superposition to indicate a first item of information, and, in response to an activation of the control organ, to displace one of the indication organs relative to the other to indicate a second item of information; a first and second cam, representing respectively the first and second item of information; a rack having a first and second probe intended to interact respectively with the first and second cam; wherein: in an inactive position of the control organ, the indication organs are superposed; and in an active position, the second indication organ indicates the second item of information.

16 Claims, 16 Drawing Sheets

ON-DEMAND DISPLAY DEVICE

TECHNICAL FIELD

The present invention relates to the field of watchmaking. It relates more specifically to a device for displaying a time indication at the demand of the user.

PRIOR ART

The document WO 2012/042448 discloses a display device of the type mentioned above. This device comprises two hands which advance in superposition, displaying a first time indication, such as the minute of the current time. On demand from the user, by operating a control organ, one of the two hands moves relative to the other to display a second item of information, such as the current hour. When the control organ is released, the two hands return to their superposed position.

To make this work, the first hand is linked to the second hand by means of an elastic organ, in order to maintain both hands in their superposed position. When the user operates the control organ, a lever pivots until a probe borne by the rack comes into contact with a cam which represents the second item of information. By doing this, a rack borne by the lever meshes with a cogwheel which acts so as to turn the second hand with regards to the first, clockwise, which therefore winds up the elastic organ. When the user releases the control organ, the elastic organ causes the second hand to turn anti-clockwise until the hands return to their superposed position.

This organ, admittedly simple, displays certain drawbacks. For example, when the user activates the control organ, the going train is subject to a relatively high torque provided by the elastic organ when it is wound up. This torque can harm the operation of the going train as well as the isochronism of the regulating organ.

The object of the invention is therefore to propose an on-demand display device in which the drawbacks mentioned above are at least partially overcome.

DISCLOSURE OF THE INVENTION

More precisely, the invention relates to a display device for a timepiece comprising a first indication organ, kinematically linked with a wheel intended to be rotated by a timepiece movement, a second indication organ, coaxial to the first indication organ, and a control device comprising a control organ intended to be activated by a user. This display device is arranged so as to drive the indication organs in superposition so as to indicate a first item of information, and, in response to activation of the control organ, to displace one of the indication organs relative to the other in order to indicate a second item of information.

According to the invention, this display device also comprises:

- a first cam, representing said first item of information, intended to be rotated by the timepiece movement;
- a second cam, representing said second item of information, intended to be rotated by the timepiece movement;
- a rack which is intended to be pivoted on an element of the frame of said timepiece movement, and kinematically linked with the second indication organ, said rack having a first probe intended to interact with the first cam and a second probe intended to interact with the second cam.

This display device is arranged so that:

- in the inactive position of the control organ, the first probe is in contact with the first cam and the indication organs are superposed;

- in the active position of the control organ, the rack is pivoted until the second probe is brought into contact with the second cam, the second indication organ being thus displaced relative to the first indication organ in such a way that the second indication organ displays the second item of information.

Therefore, when the user wants to read the complete time, the display device exerts additional torque on the base movement which is significantly lower than that applied in the device of the above-mentioned previous prior art because the spring linking the two hands is eliminated.

Advantageously, the rack comprises a toothed section which meshes with a wheel joined to the second indication organ. Therefore, simple driving of the second indication organ is obtained.

Advantageously, a return spring is arranged to exert a force which pushes the first probe towards the first cam. The return spring is advantageously a spiral spring of which one end is linked to an intermediate return wheel, engaging with said wheel connected to the second indication organ. A compact drive system is thus proposed.

Advantageously, at least one of said cams, preferably the second cam, is intended to be driven by means of a flexible arm linked to a gear wheel, which is intended to be rotated by the timepiece movement, wherein the flexible arm is arranged so as to drive said cam, preferably using a pin attached to said cam. This flexible arm can tolerate a certain angular separation between the second cam and the gear wheel, which prevents the mechanism from blocking at around 12:00 when the user activates the control organ for a certain period of time.

Advantageously, at least one of said cams, preferably the first cam, is intended to be driven using a retractable finger attached to a security wheel, the retractable finger being arranged in such a way as to drive the cam, preferably by means of a pin on the cam. Damage to the mechanism when setting the time in the wrong direction is therefore avoided.

Advantageously, the control device comprises a first toothed sector which is joined to the rack and a second toothed sector meshed with the first toothed sector. Advantageously, the control device also comprises an arming spring for the rack arranged to move between a first state in which the spring does not interact with the second toothed sector, and a second state in which the spring interacts with the second toothed sector, in order to drive the rack in such a way that the second probe is brought into contact with the second cam. Such an arrangement prevents the user from imparting force directly on the cams etc., thereby reducing risk of breaking the mechanism.

Advantageously, the control device comprises a push-button spring arranged in such a way that, in its inactive position, it brings the arming spring of the rack into said first state, and following activation by a user, it releases the rack arming spring so that the rack may move to its second state. More advantageously, the push-button spring is stronger than the arming spring of the rack, and a command lever is arranged to act on the push-button spring in such a way that the push-button spring releases the arming spring of the rack in response to an action by the user.

Advantageously, said first item of information is the minute of the present time, and said second item of information is the hour of the present time.

Advantageously, the display device also comprises a display device of a different time zone, the other time preferably being GMT. This display device of a different time zone also advantageously comprises a disk bearing indications and arranged to be driven one turn in 24 hours, the disk being visible through an aperture formed in the dial. The display device of a different time zone also comprises a cover which is arranged to move between a "closed aperture" position, in which the cover is superposed over a part of the disk and is visible through said aperture, and an "on-demand" position, in which the cover leaves that part of the disk visible. Consequently, the display of the other time zone is only visible when the display device is in the "on-demand" mode Advantageously, said display device of a different time zone comprises a correction lever adapted to modify the angular position of this disk and to move the cover into its "on-demand" position. Consequently, the cover is moved to leave the display of the different time zone visible when this time zone is corrected.

The invention also relates to a timepiece comprising a display device as defined above.

BRIEF DESCRIPTION OF THE DRAWINGS

Other details of the invention can be seen more clearly when reading the following description, made in reference to the annexed drawings, in which.

EMBODIMENT OF THE INVENTION

The present invention relates to a display device of a timepiece which is capable of displaying a first item of information, and, upon demand, a second item of information. In the following description, the embodiment described will be a specific one in which the first item of information is the minute of the current time, and the second item of information is the hour of the current time. It goes without saying that the organ can easily be adapted to other first and second items of information, for example the hour and minute of a measured time, the day of the week and the month or the date, the time in two different time zones, or any other combination of pieces of information. The required modifications to transpose the present description to a display device capable of indicating other pieces of information are within the ability of the man skilled in the art.

Furthermore, it is to be noted that, in order to not overly encumber the figures, several components are indicated either on each view from above, or on each view from below.

Figure 1A:
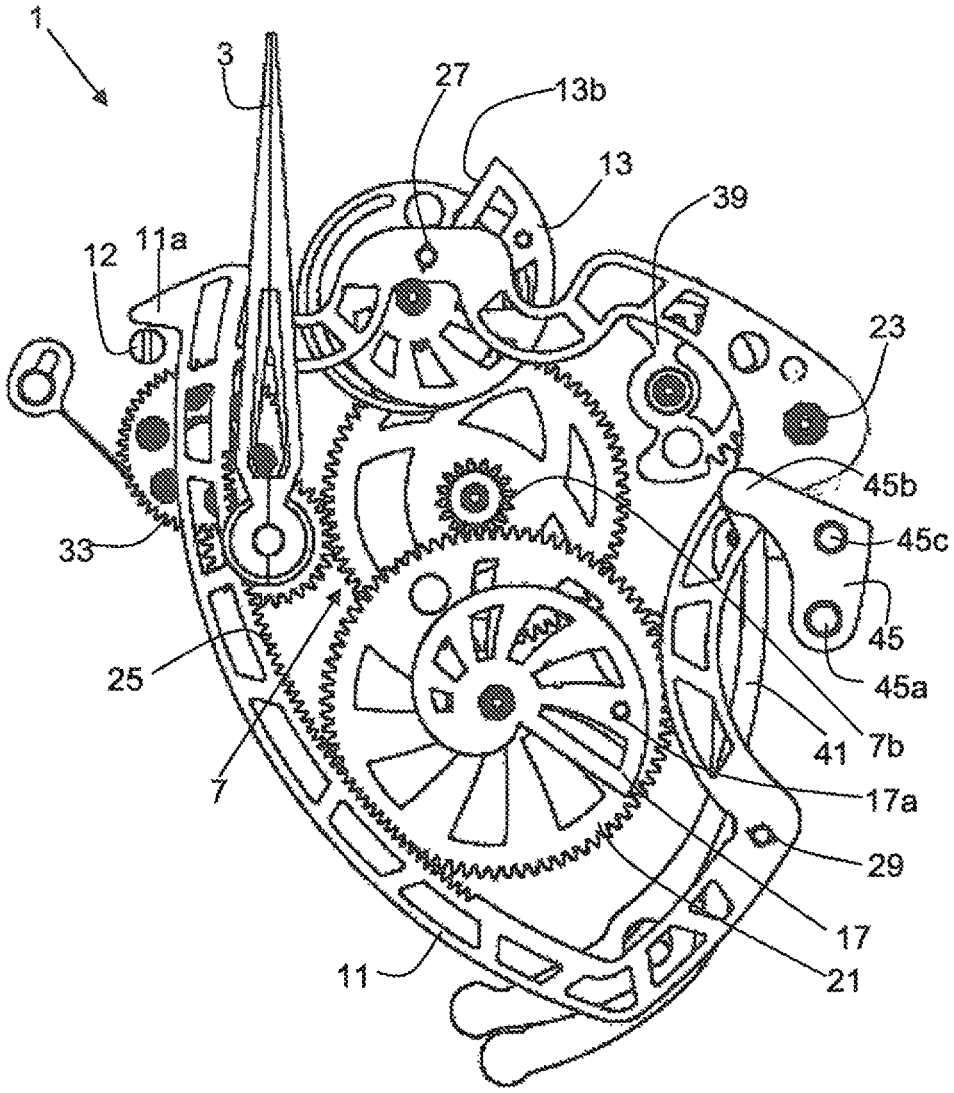
FIG. 1*a* is a view from above of the display device in the "normal" position at 12:00.
Figure 1B:
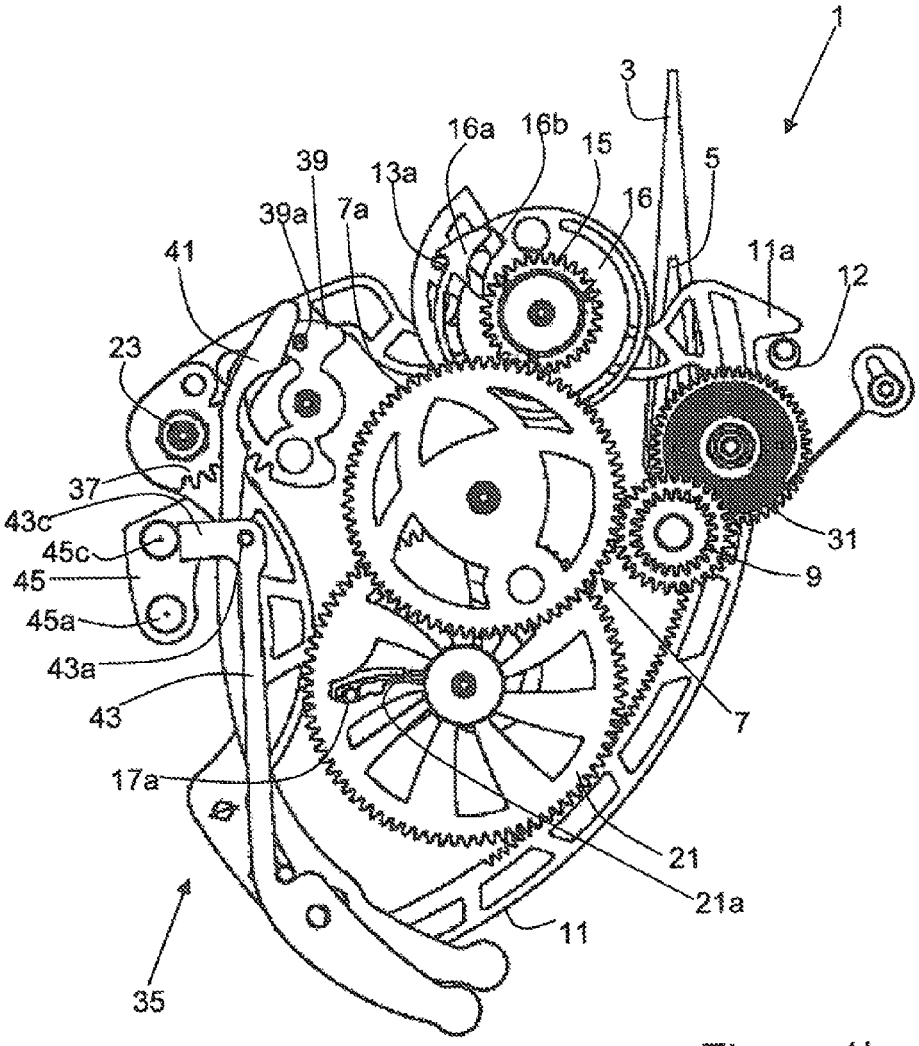
FIG. 1*b* is a view from below of the display device in the "normal" position at 12:00.
Figure 2A:
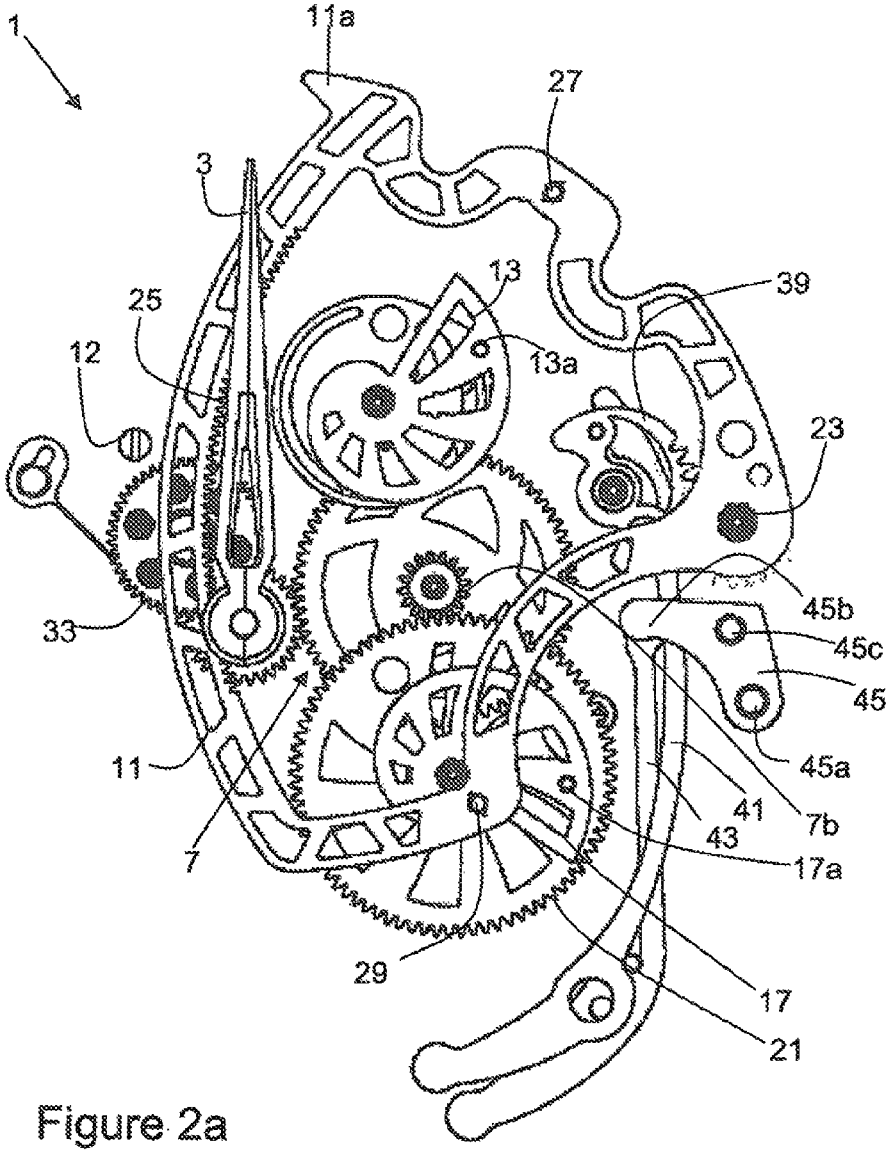
FIG. 2*a* is a view from above of the display device in the "on-demand" position at 12:00.
Figure 2B:
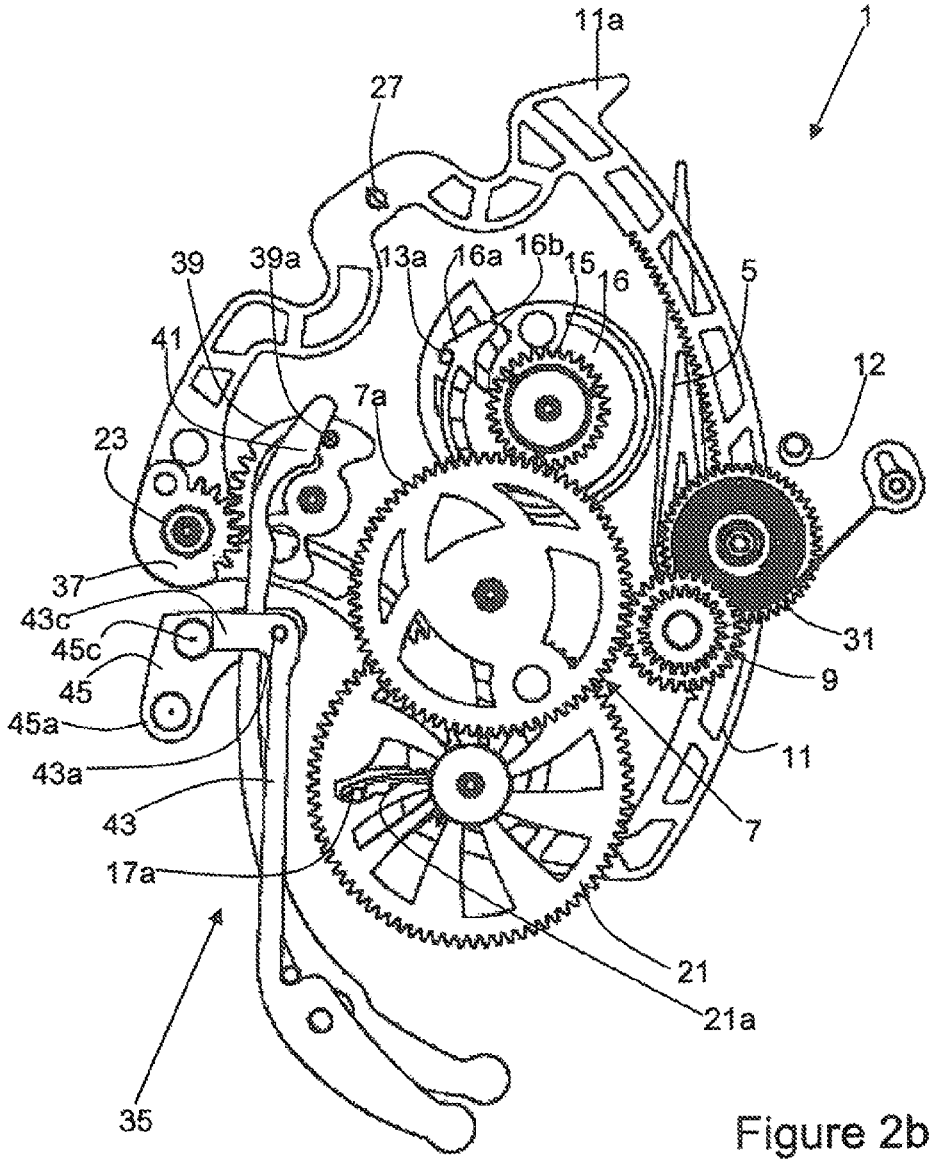
FIG. 2*b* is a view from below of the display device in the "on-demand" position at 12:00.

FIGS. 1*a* and 1*b* respectively represent views from above (dial side) and below (case back side) of a display device 1 according to the invention, which indicates 12:00 and a few seconds in the "normal" mode, i.e. without actuation of the control organ. Similarly, FIGS. 2*a* and 2*b* represent equivalent views at 12:00 in the "on-demand" mode, i.e. during an actuation of the control organ. In order to explain the structure and operation of the display device 1, representations of the components at 12:00 and a few seconds have been used, because the components are in their most extreme positions when this time is indicated.

The display device comprises a first indication organ 3 and a second indication organ 5, here a minute hand and an hour hand respectively. The minute hand 3 is driven conventionally by means of a cannon-pinion 9, which is kinematically linked to the minute wheel 7. The hour hand 5 is driven by a toothed section 25 borne by a rack 11, via a wheel fixed to with the hour hand (not visible), in the present example an hour pinion, located between the cannon-pinion 9 and the hands 3, 5, as will be better understood hereafter.

A minute cam 13, constituting the first cam, is driven rotationally, one full turn per hour, by the lower teeth 7*a* of the minute wheel 7, by means of a wheel 15 of the minute cam as well as a security wheel 16. The shape and angular position of the minute cam 13 are representative of the minutes of the hour of the current time. The wheel 15 is in rotational connection with a security wheel 16, which drives the minute cam 13 using an elastic retractable finger 16*a* which presses against the pin 13*a* fixed on the minute cam 13. This elastic retractable finger 16*a* is arranged in such a way that, when the time of the device is set in the wrong direction, it can retract itself into a notch 16*b* provided in the security wheel 16, which reduces the risk of causing damage.

Furthermore, an hour 17, constituting the second cam, is driven rotationally, one full turn every 12 hours by means of the upper teeth 7*b* of the minute wheel 7, and by a wheel 21 of the hour cam. The shape and angular position of the hour cam 17 are representative of the hours of the current time. The wheel 21 of the hour cam is cut away and presents a flexible arm 21*a* arranged inside an opening formed in the wheel 21, extending from its centre outwards. This flexible arm drives the hour cam 17 by pressing on a pin 17*a* secured thereto. This flexible arm avoids all blockage of the mechanism at midnight or midday when the control organ is activated for a prolonged period, for a duration of up to around five minutes, because it allows a small relative angular displacement between the hour cam 17 and the wheel 21 of the hour cam.

The rack 11 is pivotally mounted on an axis of a rack 23, its toothed section 25 being located on the inner side of the rack 11 and meshed with said hour pinion (not visible). The rack 11 also comprises a first probe 27, which is intended to come into contact with the surface of the minute cam 13, and a second probe 29, which is intended to come into contact with the surface of the hour cam 17. The extreme angular position of the rack in the anticlockwise direction (in reference to the views of FIGS. 1*a* and 2*a*) is defined by an eccentric stud 12, against which a beak 11*a* attached to the rack 11 pushes. By turning this eccentric stud 12, the extreme angular position of the rack can be adjusted.

In its "normal" position, i.e. without action on the control organ, the first probe 27 is maintained in contact with the surface of the minute cam 13, as a result of a force supplied by a return spring 31, formed as a spiral spring, which is also acts so as to suppress play of the hour hand 5. The return spring 31 exerts a torque on a return wheel 33, which meshes with the hour pinion (not visible). The hour pinion (not visible) is thus sufficiently tall to mesh with the return wheel 33 and the toothed section 25 at the same time. The return spring 31 is wound up when the rack 11 pivots clockwise (in reference to the views of FIGS. 1*a* and 2*a*), and therefore acts to pivot the rack 11 anticlockwise (also in reference to the views of FIGS. 1*a* and 2*a*) so as to keep the first probe 27 in contact with the surface of the minute cam 13.

During the normal operation of the mechanism, the movement turns the minute wheel 7, thereby driving the minute cam 13, the hour cam 17, and the minute hand 3. The first probe 27 being kept in contact with the surface of the minute cam 13, this probe follows the surface of the cam when it turns, thereby also moving the rack 11 and driving the hour hand 5 in synchronism with the minute hand 3. The hour hand 5 being hidden by the minute hand 3, which is driven directly by the minute wheel 7, the hour hand 5 remains invisible to the user. At the end of an hour, i.e. just before the minute hand 3 makes the transition from xx:59 to (xx+1):00, the first probe 27 is at the summit of the surface of the minute cam 13. Immediately afterwards, the first probe 27 falls along the radial part 13*b* of the first cam 13 until it comes back into contact with the point of smallest radius of the first cam 13.

During this fall of the first probe 27 to the bottom of the first cam 13, the rack 11 returns to its initial position (as illustrated in the FIGS. 1*a* and 1*b*), and consequently the hour hand 5 makes a complete backwards turn in the anticlockwise direction, and is hidden once more by the minute hand. Subsequently, hands, 3 and 5, recommence their journey in superposition.

In order to be able to display the second item of information of the current time, i.e. the hours in this case, the display device 1 also comprises a control device 35, which controls the rack 11 via a first toothed sector 37 arranged on the axis of rack 23 and connected to the rack 11. The first toothed sector 37 itself meshes with a second toothed sector 39, which has a pin 39*a* against which an arming spring for the rack 41 is intended to come into contact. The arming spring of the rack 41 pushes the pin 39*a* towards the inside of the rack 11 (i.e. towards to the right of the FIGS. 1*b* and 2*b*), and therefore acts to turn the rack 11 to display the hour, i.e. in the anticlockwise direction in FIGS. 1*b* and 2*b*.

In the "normal" state, the rack arming spring 41 is prevented from acting on the rack by a push-button spring 43. The push-button spring 43 has a pin 43*a* which presses against the rack arming spring 41 when in the "normal" state of operation. The push-button spring 43 is stronger than the rack arming spring 41, and acts so as to position this latter towards the exterior of rack 11, i.e. towards the left on FIG. 1*b*, so that the rack arming spring 41 is not in contact with the pin 39*a* of the second toothed sector 39. Consequently, in the "normal" position, the second toothed sector 39 is left free by the rack arming spring 41, and turns in synchronism with the movements of the rack 11.

To read the "complete" time in the "on-demand" position of the display device 1, the user presses a control organ (not illustrated), such as a push button, a lever or a bolt located on the outside of the timepiece inside which the display device 1 is integrated. This control organ pivots a control lever 45 (see FIGS. 2*a* and 2*b*) around its pivot axis 45*a* by acting on the lever 45, so as to pivot it anticlockwise in reference to FIG. 1*a* and clockwise in reference to FIG. 1*b*.

In doing this, a control stud 45*c* located between the pivot axis 45*a* of the lever 45 and its free extremity 45*b* pushes against an abutment 43*c* comprised by the push-button spring 43, in the direction of the centre of the rack 11, i.e. towards the right on FIGS. 1*b* and 2*b*. The pin 43*a* of the push-button spring 43 progressively releases the rack arming spring 41, which, at a certain point (which varies depending on the position of the second toothed section 39), comes into contact with the pin 39*a* of the second toothed sector 39, driving it clockwise (in reference to FIGS. 1*b* and 2*b*).

The rack arming spring 41 applies a torque on the rack 11, tending to drive it anticlockwise (in reference to FIGS. 1*b* and 2*b*), which is higher than the one applied in the opposite direction by the return spring 31. Consequently, the rack 11 pivots anticlockwise, making the hour hand 5 rotate clockwise via the toothed section 25, until the second probe 29 comes into contact with the surface of the second cam 17, which is representative of the current hour. The hour hand 5 will then indicate the current hour, and the minute hand 3 will continue to indicate the current minute, because it is not joined to the hour pinion.

In the illustrated case, which is 12:00 plus a few seconds, the first probe 27 is located at the bottom of the first cam 13 before activation of the control organ, and the second probe 29 is situated at the bottom of the second cam 17 after said activation. Therefore, the rack passes from one extreme angular position (FIG. 1*a*, 1*b*) to the other (FIG. 2*a*, 2*b*), and makes the hour hand 5 go around twice clockwise to indicate the hour. Nevertheless, depending on the meshing play between the cams 13, 17 and the timer wheel 7, two other cam positions can appear at approximately 12:00:

A) The first probe 27 is at the summit of the cam, and, when the control organ is activated, the second probe 29 meets the second cam 17 at its summit. In this case, the hour hand 5 does not move when the device goes from the "normal" position" to the "on-demand" position.

B) The first probe 27 is at the bottom of the cam and, when the control organ is activated, the second probe 29 meets the second cam 17 at its summit. In this case, the hour hand 5 goes round one time, clockwise, when the device goes from the "normal" position" to the "on-demand" position.

If the user keeps the control organ pressed for a prolonged period at midnight or midday, the flexible arm 21*a* of the wheel 21 of the hour cam begins to flex, because the wheel 21 will continue to turn under the effect of the minute wheel whilst the hour cam 17 is blocked. As explained above, this flexing allows to tolerate an angular discrepancy between the wheel 21 and the hour cam 17 equal to around 5 minutes of pressure on the control organ, which equates to 30°.

When the user releases the control organ, the command lever returns to its original position as illustrated in FIGS. 1*a* and 1*b* under the effect of the push-button spring 43, which returns its pin 43*a* back into contact with the rack arming spring 41. The rack arming spring 41 is therefore pushed towards the exterior of the rack (i.e. towards the left in FIGS. 1*b* and 2*b*), and progressively frees the second toothed sector 39. The rack 11 therefore returns to its initial position with the first probe 27 in contact with the minute cam 13, due to the effect of the return spring 31 via the hour pinion (not visible) and the toothed section 25.

Similarly to FIGS. 1*a* and 1*b*, FIGS. 3*a* and 3*b* illustrate the positions of the components of display device 1 at 13:48 in the "normal" position. In order to avoid over-encumbering these figures, only the reference numerals that have been mentioned in the text below have been reproduced on FIGS. 3*a* and 3*b*.

As is clearly visible in FIGS. 1*a* and 1*b*, the minute hand 3 and the hour hand 5 are superposed and indicate 48 minutes. Compared to FIGS. 1*a*, 1*b*, 2*a* and 2*b*, the rack 11 is located in an intermediate position. The second toothed sector 39 meshes with rack 11 via the first toothed sector 37, and is also in an intermediate position compared to FIGS. 1*a*, 1*b*, 2*a* and 2*b*. The rack arming spring 41 is maintained in the same position as in FIGS. 1*a* and 1*b* by the push-button spring 43, and therefore is clearly separated from the pin 39*a* of the second toothed sector in the position illustrated in FIGS. 3*a* and 3*b*.

Figure 3A:
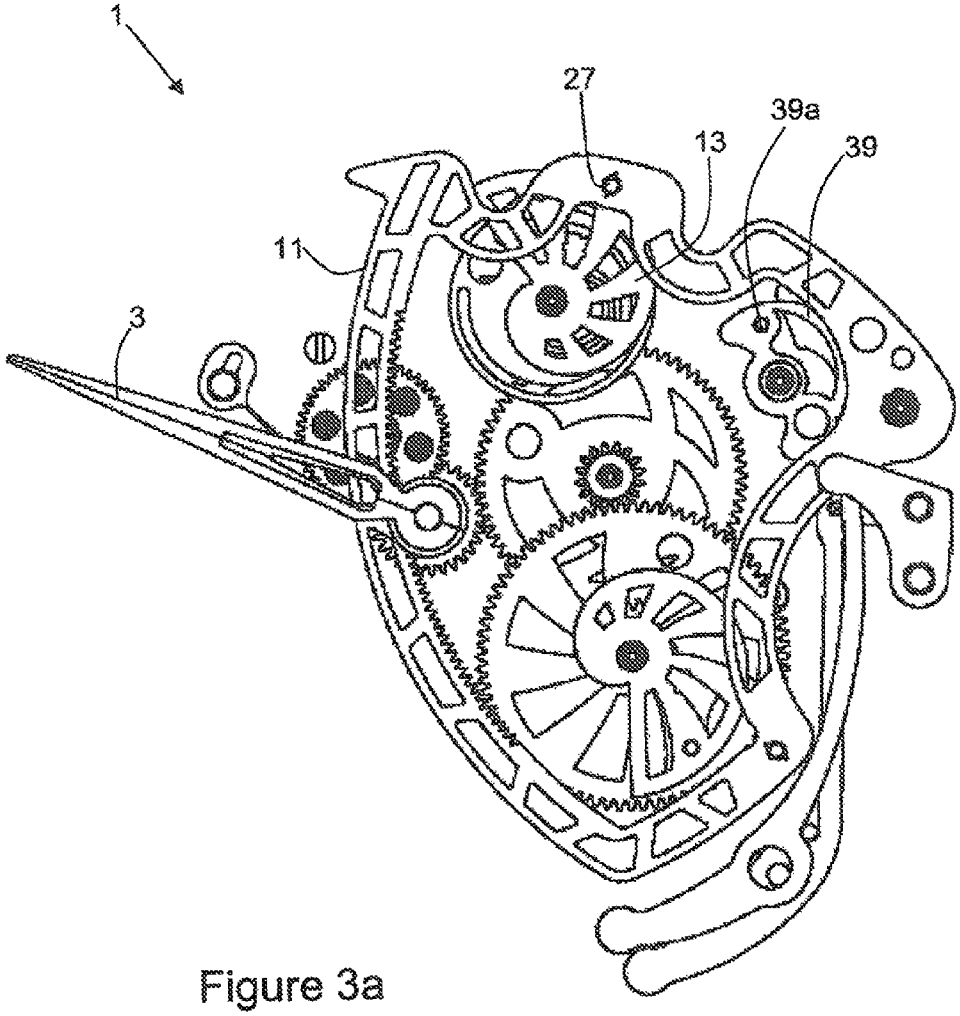
FIG. 3*a* is a view from above of the display device in the "normal" position at 13:48.
Figure 3B:
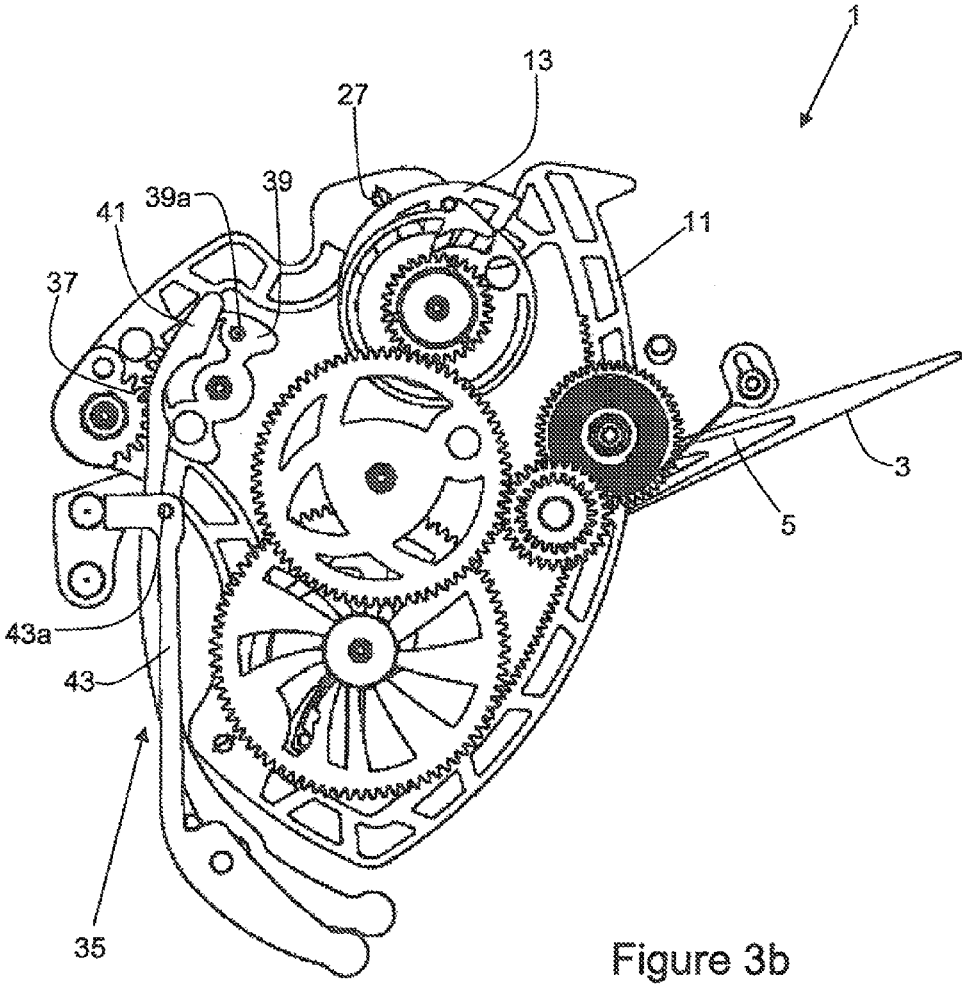
FIG. 3*b* is a view from below of the display device in the "normal" position at 13:48.

In addition, FIGS. 3*a* and 3*b* show more clearly the interaction between the first probe 27 and the first cam 13.

Figure 4A:
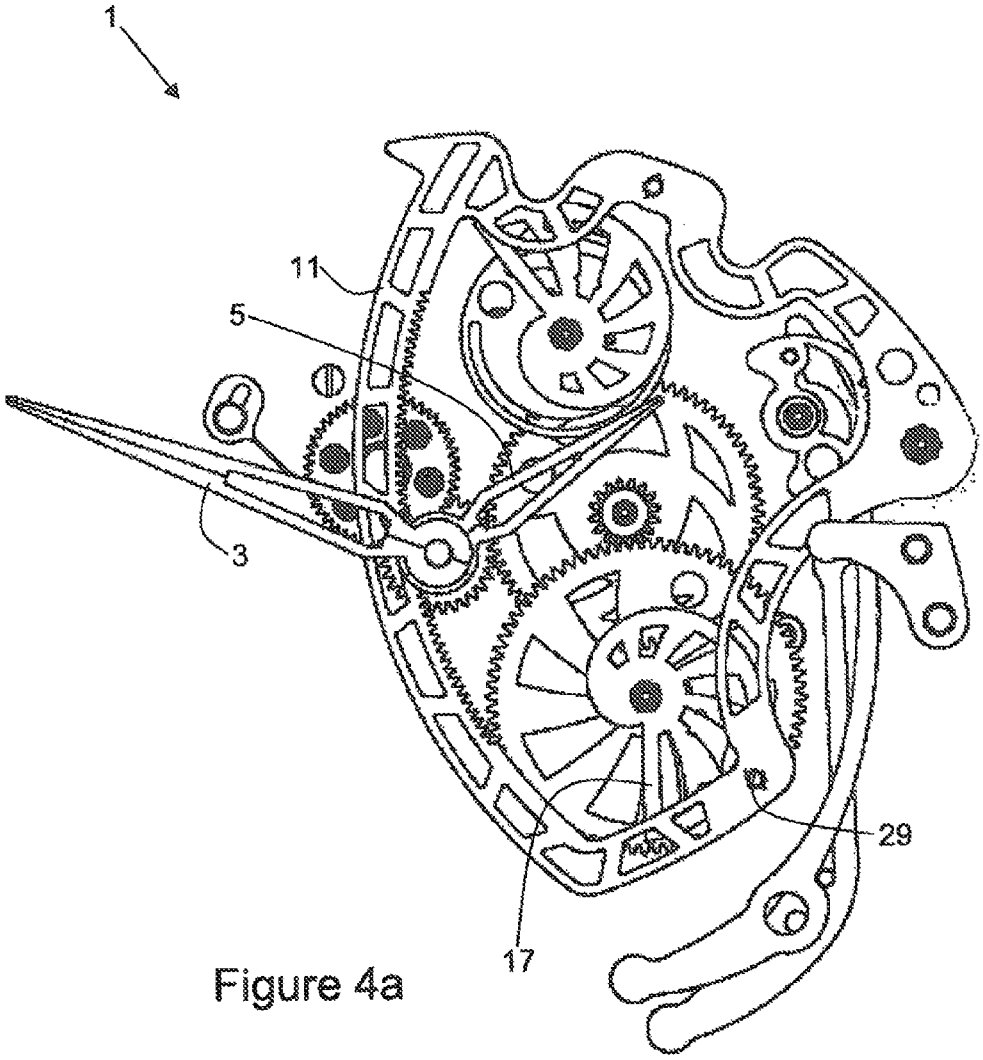
FIG. 4*a* is a view from above of the display device in the "on-demand" position at 13:48.

Moving on to FIGS. 4*a* and 4*c*, which show the display device 1 in the "on-demand" position a similar manner to FIGS. 2*a* and 2*b*. The control device 35 has functioned as described above in reference to FIGS. 2*a* and 3*a*, and consequently the push-button spring 43 has freed the rack arming spring 41, which pushes against the pin 36*a* of the second toothed sector 39, thereby pushing the rack 11 clockwise (in reference to FIG. 4*a*) until the second probe 29 returns into contact with the surface of the hour cam 17, driving the hour hand 5 clockwise to indicate the complete time. It is to be noted that the pin 43*a* comprised by the push-button spring 43 is not in contact with the rack arming spring 41, because the rack 11 (and consequently the pin 39*a*) stops in an intermediate position, and therefore the rack arming spring 41 also stops in an intermediate position.

Figure 4B:
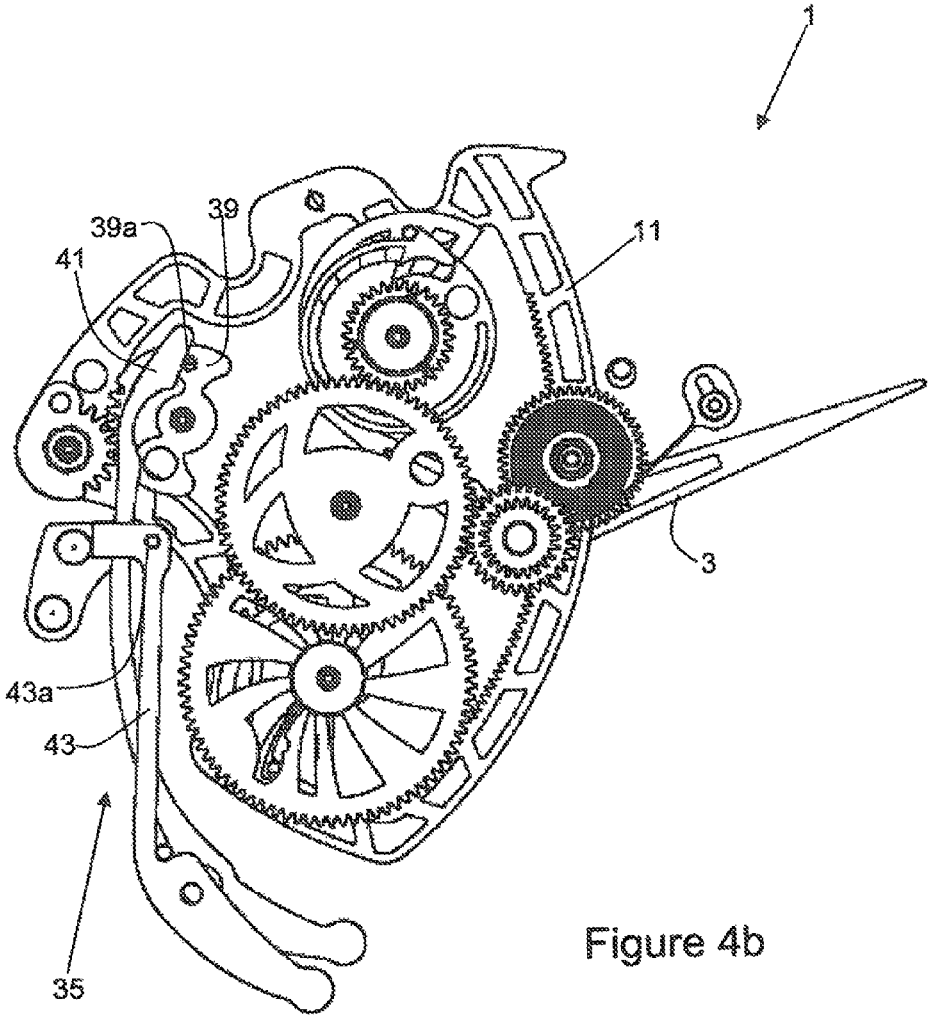
FIG. 4*b* is a view from below of the display device in the "on-demand" position at 13:48.

The display device 1 further comprises a different time zone display device 50 (see FIGS. 5 to 7), especially for GMT, but any other time zone can be chosen. In order to not make the following description heavier, we will only refer to GMT; however, it is to be understood that any time zone may be indicated. In addition, given the high complexity of the GMT display device 50 as well as the base display device 1, some components have not been represented on some of the figures, and only the components of the base display device 1 that are necessary for understanding of the GMT display device 50 have been represented in FIGS. 5 to 7. In a similar manner to FIGS. 2 to 4, only the reference numerals indicated in the reference text for each figure are reproduced in the figures.

Figure 5A:
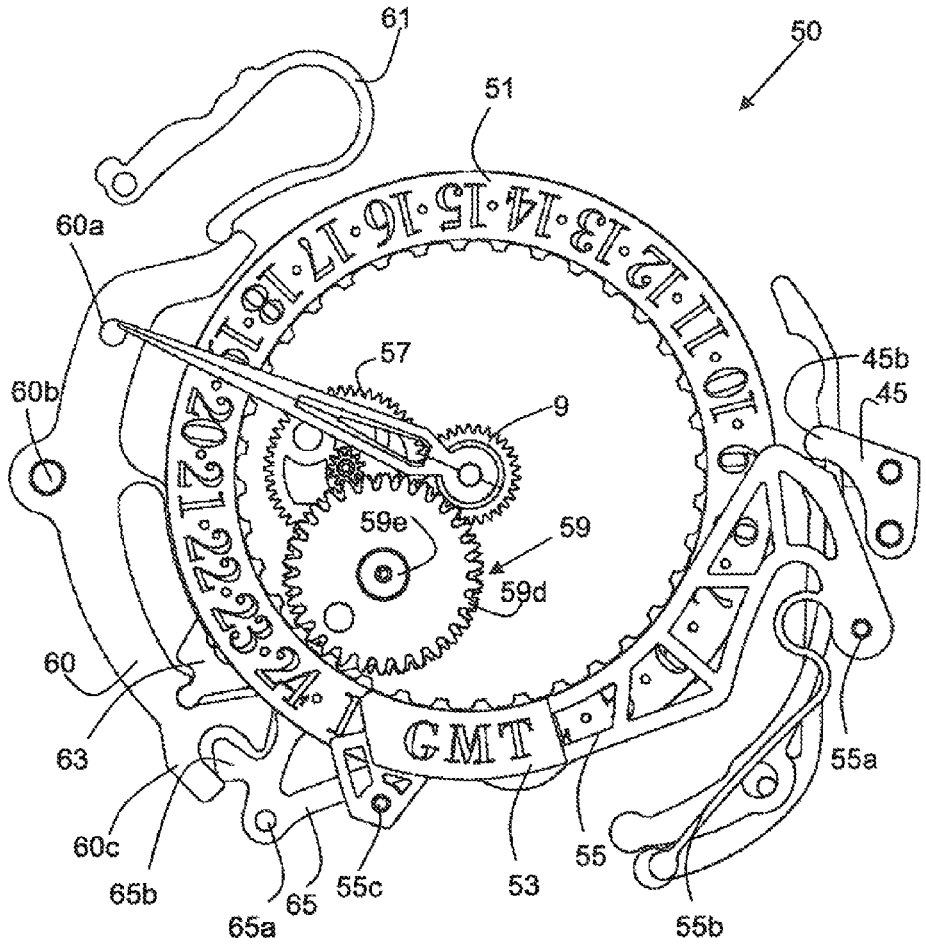
FIG. 5*a* is a view from above of the GMT display device in the "normal" position at 13:48.
Figure 5B:
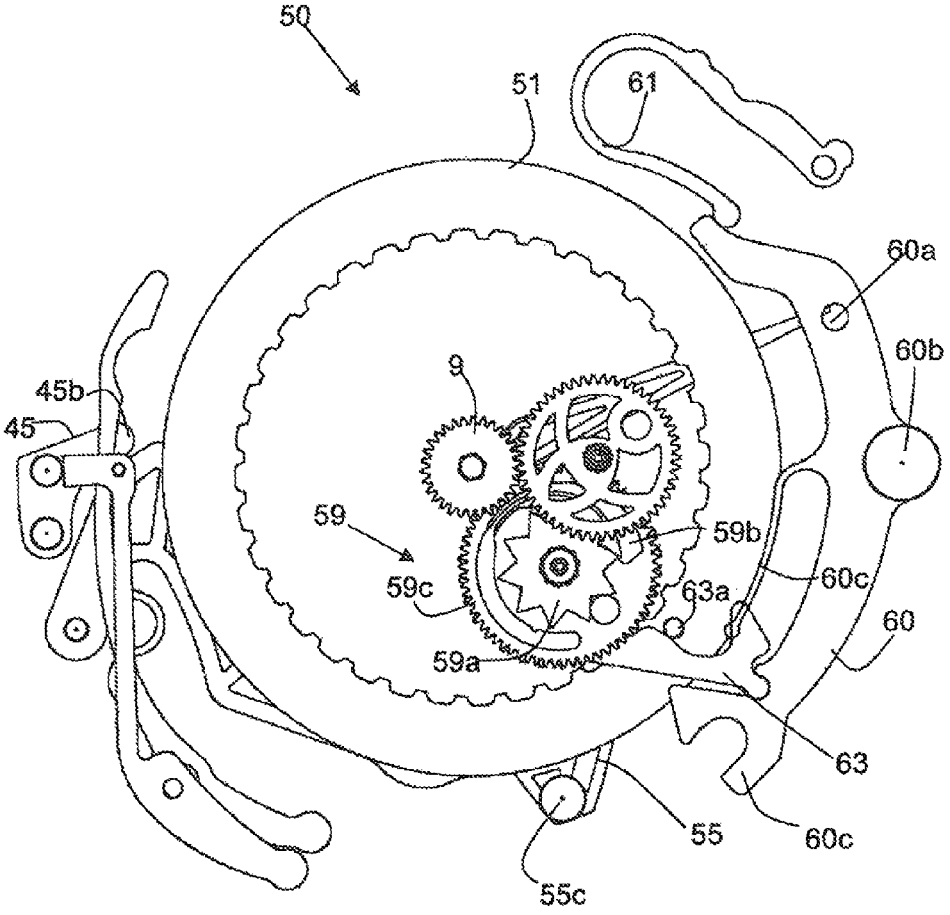
FIG. 5*b* is a view from below of the GMT display device in the "normal" position at 13:48.

As can be seen in FIGS. 5*a* and 5*b*, the GMT display device 50 comprises a 24-hour disk 51 with internal teeth, visible through an aperture (not shown) formed in the dial of the timepiece in which it is integrated. The disk 51 is arranged to turn once in 24 hours.

In the normal position of the display device 1, a cover 53 associated with a cover lever 55 is interposed between disk 51 and the aperture in order to hide the disk 51 (see FIG. 5*a*, position called "closed aperture"). The cover lever 55 pivots at 55*a* and is associated with an elastic element 55*b* which tends to keep the cover 53 in the "closed aperture" position. The elastic element 55*b* is formed from as a single piece with the cover lever 55, but other types of elastic elements, indeed springs, can be used. It is also to be noted that the cover lever 55 is constructed in skeletal form, meaning it is hollowed out, but it can also be constructed in a solid manner. The cover lever 55 is activated by the free end 45*b* of the control lever 45, as well as by a stud 55*c* which is located near its free end, as will be understood better below.

The disk 51 is driven conventionally by the base movement via a first intermediate wheel 57 as well as a second intermediate wheel 59 which comprises, as is known, a starwheel 59*a*—jumper 59*b* link linking a first wheel 59*c*, which cooperates with the first intermediate wheel 57, and a second wheel 59*d*, which cooperates with the internal toothing of the disk 51. To this end, the starwheel is rotationally joined with the second wheel 59*d* through a tubular axis 59*e*, and the jumper 59*b* is joined with the first wheel 59*c*.

Figure 6A:
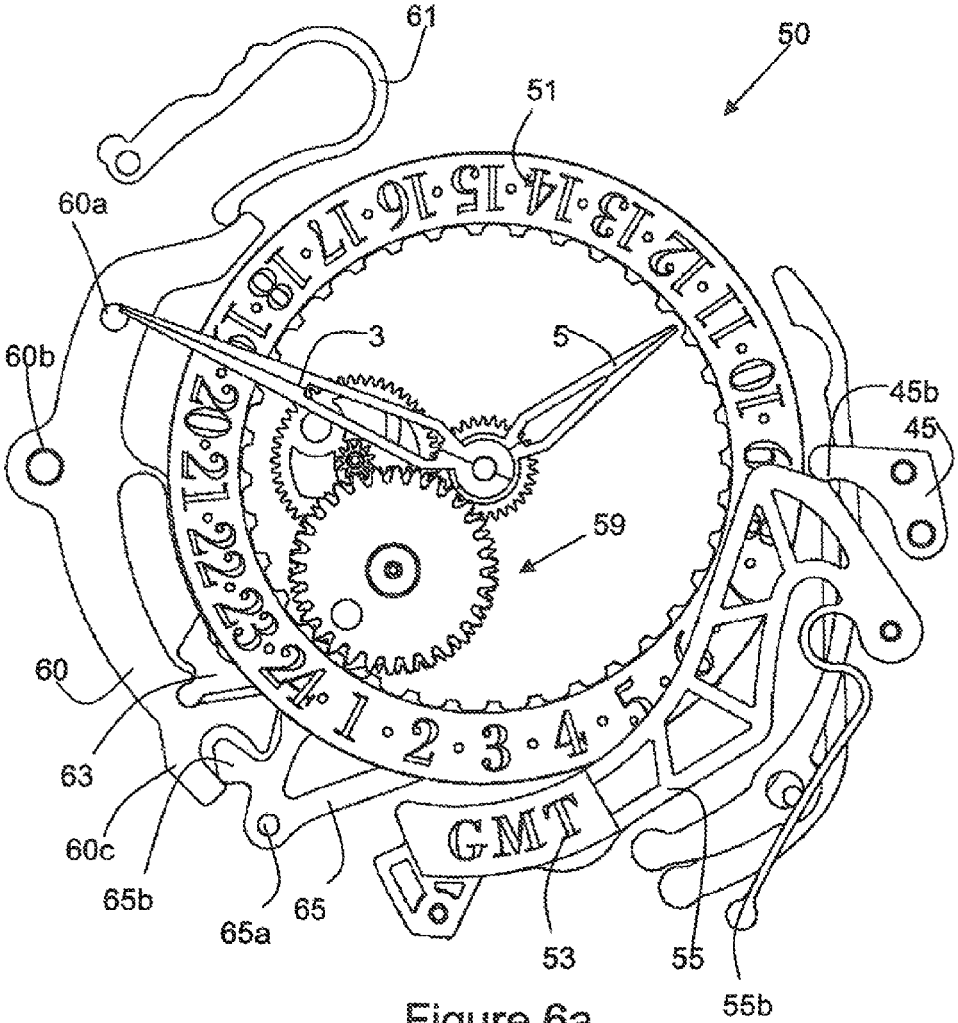
FIG. 6*a* is a view from above of the GMT display device in the "on-demand" position at 13:48.
Figure 6B:
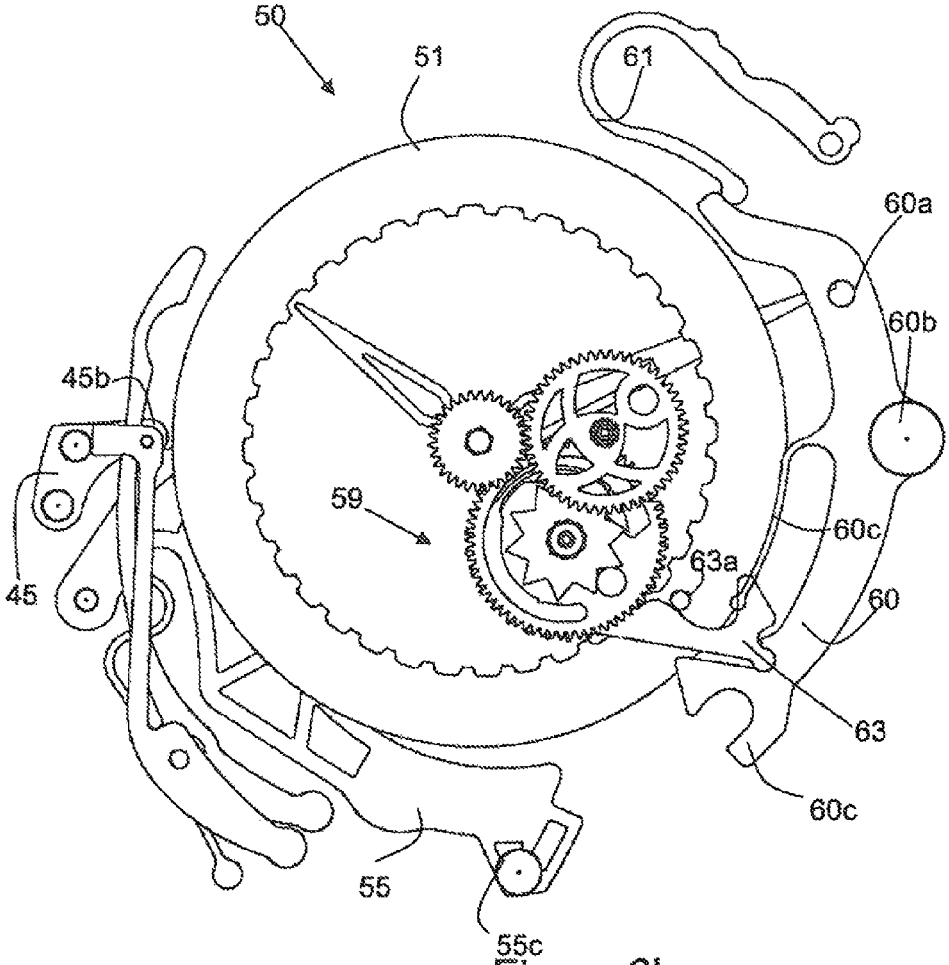
FIG. 6*b* is a view from below of the GMT display device in the "on-demand" position at 13:48.
Figure 7A:
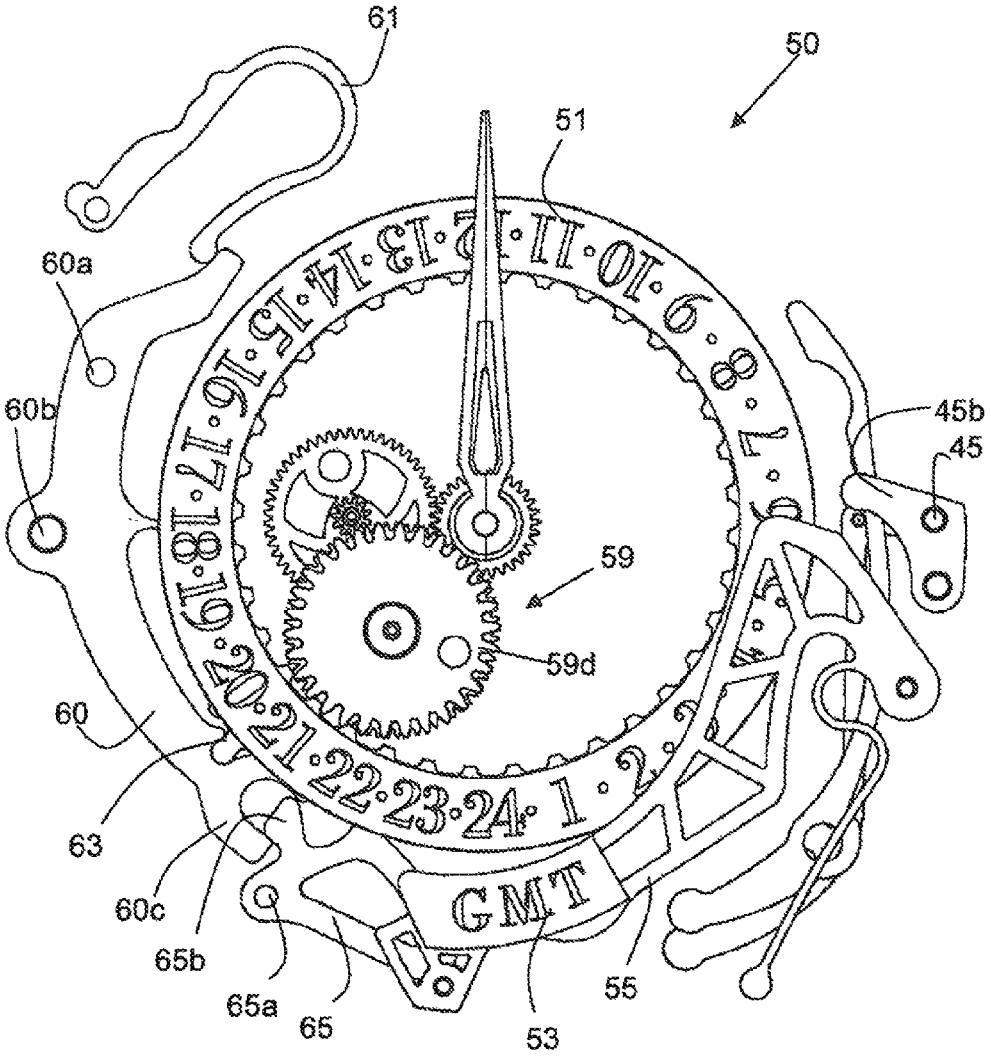
FIG. 7*a* is a view from above of the GMT display device during a correction of the GMT display at 12:00.

FIGS. 6*a* and 6*b* represent the GMT organ in the "on-demand" position. The hands 3, 5 indicate the complete time, and the free end 45*b* of the control lever 45 pushes the cover lever 55 so that the cover 53 is moved away from the aperture and that the GMT time is readable through the aperture. When the user releases the exterior control organ, the elastic element 55*b* pushes the cover 55 back into the "closed aperture" position, as illustrated in FIGS. 5*a* and 5*b*.

Figure 7B:
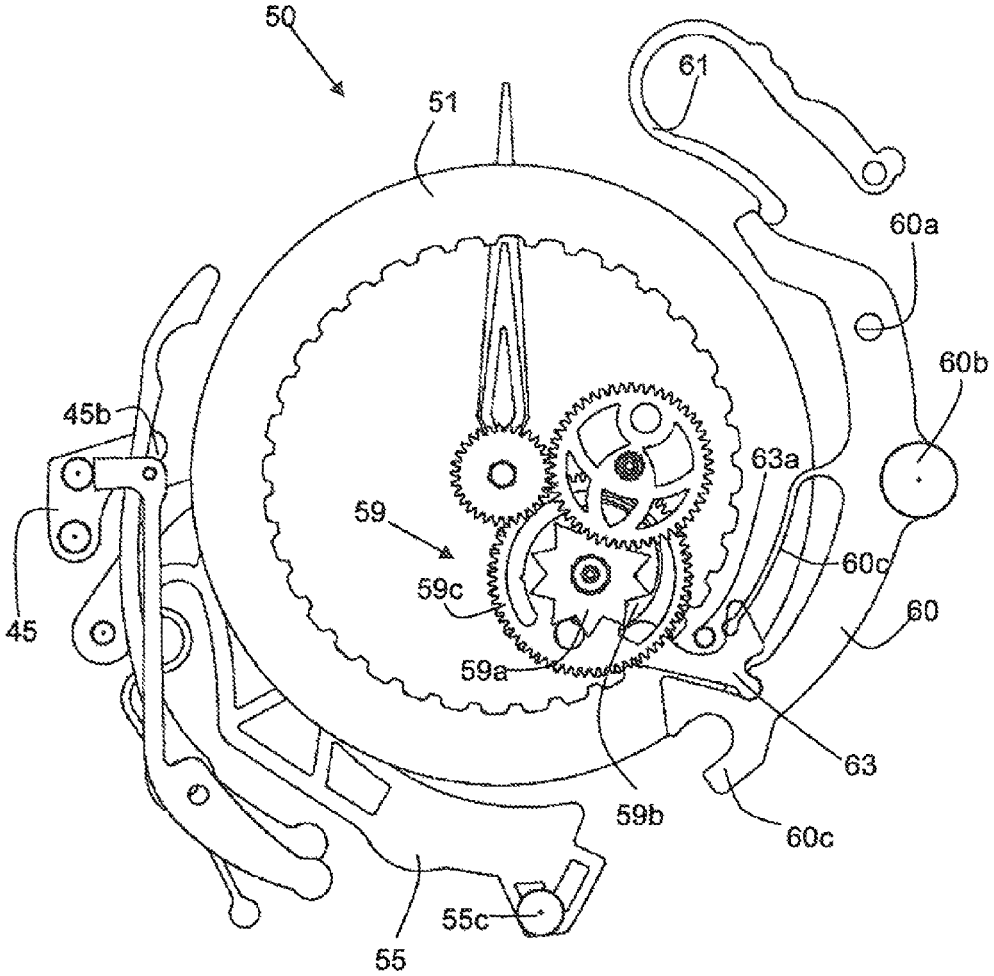
FIG. 7*b* is a view from below of the GMT display device during a correction of the GMT display at 12:00.
Figure 8A:
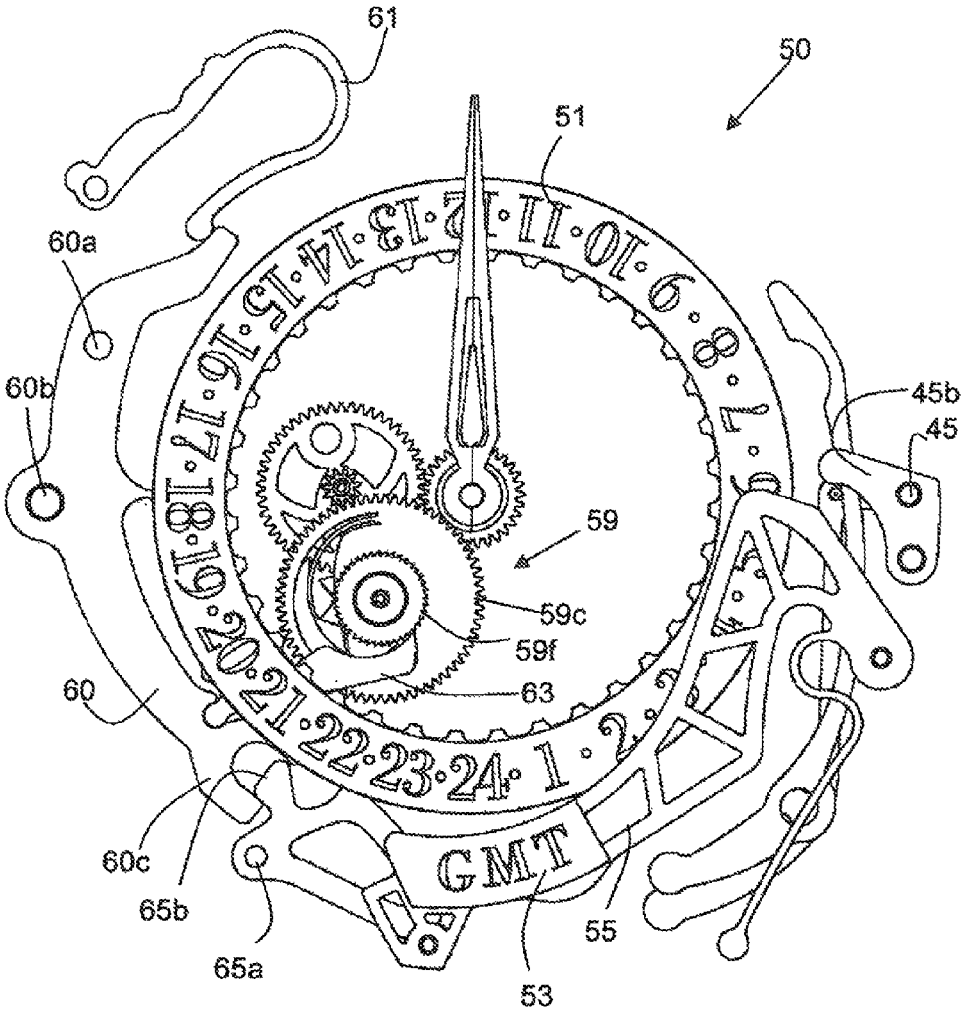
FIG. 8*a* is a similar view to that of FIG. 7*a*, with several wheels removed.
Figure 8B:
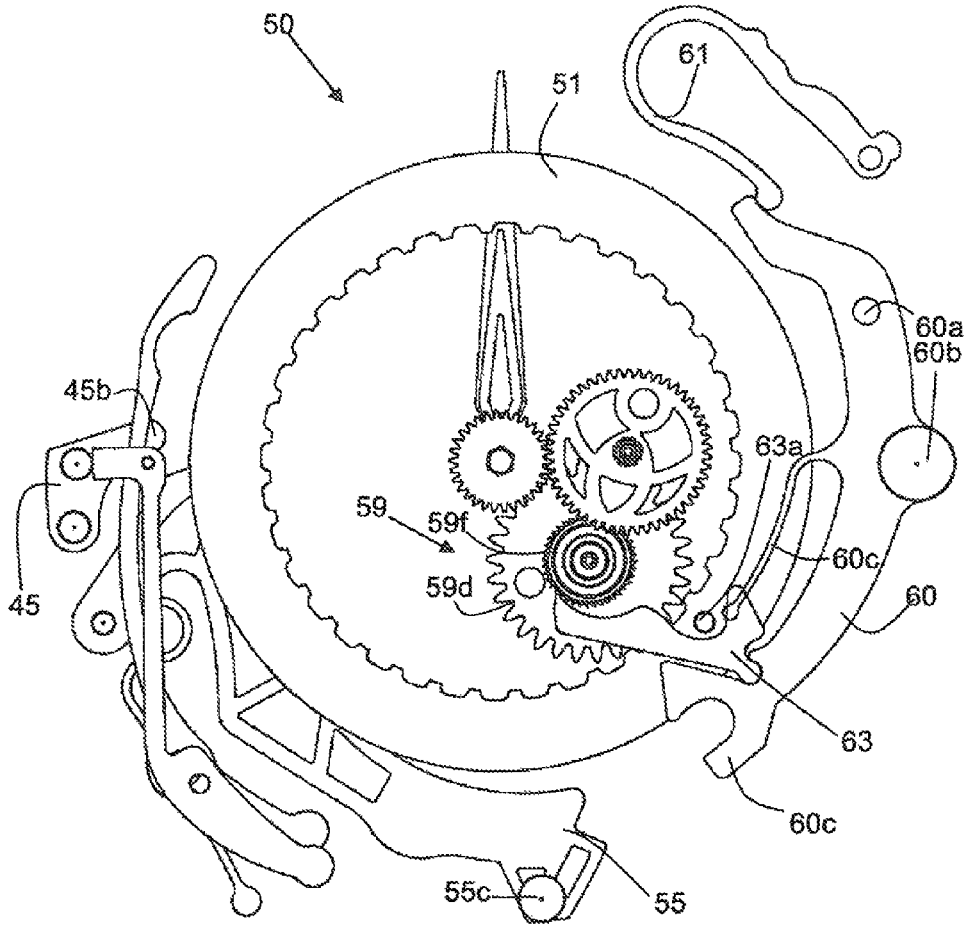
FIG. 8*b* is a similar view to that of FIG. 7*b*, with several wheels removed.

The GMT display device 50 also comprises a correction mechanism, which will be described mainly with reference to FIGS. 7 and 8, which show the mechanism during a correction of the GMT display. This correction mechanism comprises a correction lever 60, activated by the user by means of a control organ (not illustrated) such as a button located outside the watch case, preferably at 9:00, which pushes against a stud 60*b* comprised by the correction lever 60. This correction lever 60 is illustrated in its rest position in FIGS. 5 and 6, and in its activated position in FIGS. 7 and 8. The correction lever 60 pivots around a stud 60*a* and is associated with an elastic element 61 which tends to return it back into its rest position (as illustrated in FIGS. 5 and 6).

The correction lever 60 cooperates with a correction beak 63 articulated on the lever 60, and which penetrates into the second intermediary wheel 59, between the first wheel 59*c* and the second wheel 59*d*. These last two wheels have been removed from FIGS. 8*a* and 8*b* in order to show a ratchet wheel 59*f*, connected to the second wheel 59*d*. In the rest position, a pin 63*a* keeps the rod away from the ratchet wheel 59*f*. A leaf spring 60*c* comprised by the correction lever 60, tends to maintain the finger in contact with this pin 63*a*.

When the correction lever 60 pivots following an action of the user on the corresponding control organ, the edge of the correction finger 63 penetrates into the teeth of the ratchet wheel 59*f* and makes it turn together with the second wheel 59*d*, to which it is rotationally connected. The second wheel 59*d* meshing with the internal teeth of disk 51, this disk is advanced by a step corresponding to one hour, i.e. $1/24^{th}$ of a turn. The first wheel 59*c* being constrained by the base movement, the rotation of the ratchet wheel 59*f* lifts the jumper 59*b* which thus positions itself in the next hollow of the starwheel 59*a*, which assures that the step taken by the disk 51 is 1/24th of a turn.

At the same time, the correction lever 60 moves the cover 53 by means of an auxiliary lever 65 (only visible in FIGS. 5*a*, 6*a*, 7*a* and 8*a*). The auxiliary lever 65 interacts with the correction lever 60 by means of a lug 65*b* and a fork 60*c*, and pivots at 65*a* in order to push against the stud 55*c* comprised by the cover lever 55. Consequently, the user can see the GMT display during a correction.

Once the user releases pressure on the control organ, the correction lever 60 returns to its rest position by the effect of its spring 61, the finger 63 moves away from the ratchet wheel 59*f*, and the cover 53 closes. Therefore, the components of the correction organ return to their rest positions as illustrated in FIGS. 5 and 6.

Even though the invention has been described in reference to a specific embodiment, several modifications of the display device are conceivable without leaving the scope of the invention as defined by the appended claims. For example, it is conceivable that the rack 11 could be of an open shape and not a closed one. Other arrangements of the return spring 31 are possible. For example, the return wheel 33 could directly mesh onto the toothed section 25, or an additional toothed section could be provided on the rack. The return spring 31 could be arranged as a helical spring or a leaf spring acting directly on the rack, or even acting on the first toothed sector 37 or the second toothed sector. The toothed sectors 37 and 39 could take the form of toothed wheels, and the second toothed sector 39 could be arranged at the outside of rack 11. Furthermore, one could imagine any number of variations of the control device 35. For example, the rack arming spring could directly act on a pin or a stud attached to the rack 11. Alternatively, one could act directly on the first toothed section 37 by means of a wheel driven directly by a pushed button, a lever or a bolt. The first toothed sector 37 could be flexible, meaning that its teeth could be linked to the hub using elastic elements, in order to absorb a possible extra travel of the toothed section by deformation of the blades, removing any risk of breaking the components when activating the control organ. Finally, with regards to the driving of the two cams 13, 17, it is possible to provide a retractable finger 16*a* on the first cam 13 and the pin 13*a* on the wheel 16, and/or arrange the elastic arm 21*a* on the second cam 17 and the pin 17*a* on the wheel 21 of the hour cam.

Furthermore, it is to be noted that the GMT display device can be used in a different context, for example in combination with a conventional display of the current time, with the cover being activated by means of any control organ.

The invention claimed is:

1. Display device for a timepiece comprising:

a first indication organ kinematically linked to a wheel which is intended to be rotated by a timepiece movement;

a second indication organ, coaxial to the first indication organ;

a control device comprising a control organ intended to be activated by a user;

said display device being arranged to drive said indication organs in superposition in order to indicate a first item of information, and, in response to an activation of the control organ, to displace one of the indication organs relative to the other in order to indicate a second item of information;

characterised in that said display device comprises:

a first cam, representing said first item of information, intended to be driven by the timepiece movement;

a second cam, representing said second item of information, intended to be driven by the timepiece movement;

a rack intended to be pivoted on a frame element of the timepiece movement and kinematically linked with the second indication organ, said rack having a first probe intended to interact with the first cam and a second probe intended to interact with the second cam;

said display device being arranged in such a way that:

in an inactive position of the control organ, the first probe is in contact with the first cam and the indication organs are in superposition;

in an active position of the control organ, the rack is pivoted until the second probe is brought into contact with the second cam, the second indication organ being thus—displaced relative to the first indication organ such that the second indication organ indicates the second item of information.

2. Display device according to claim 1, wherein the rack comprises a toothed section which meshes with a wheel connected to the second indication organ.

3. Display device according to claim 1, wherein a return spring is arranged to exert a force tending to push the first probe towards the first cam.

4. Display device according to claim 2 wherein the return spring is a spiral spring of which one end is linked to a return wheel, the return wheel engaging with said wheel connected to the second indication organ.

5. Display device according to claim 1, wherein at least one of said cams, preferably the second cam, is intended to be driven by means of a flexible arm comprised by a gear wheel, which is intended to be rotated by the timepiece movement, the flexible arm being arranged so as to drive said cam.

6. Display device according to claim 1, wherein at least one of said cams, preferably the first cam, is intended to be driven using a retractable finger comprised by a security wheel, this retractable finger being arranged to drive said cam.

7. Display device according to claim 1, wherein the control device comprises a first toothed sector connected to the rack, and a second toothed sector meshing with the first toothed section.

8. Display device according to claim 7, wherein the control device comprises a rack arming spring arranged to move between a first state in which said spring (41) does act on the second toothed sector, and a second state in which said spring acts on the second toothed section, in order to drive the rack in such a way that the second probe is brought into contact with the second cam.

9. Display device according to claim 8, wherein the control device comprises a push-button spring arranged such that, in its rest position, it brings the rack arming spring into said first state, and in response to an action of a user, it releases said rack arming spring such that this latter may move towards its second state.

10. Display device according to claim 9, wherein the push-button spring is stronger than the rack arming spring, and a command lever is arranged to act on the push-button spring in such a way that this latter releases the rack arming spring in response to an action by a user.

11. Display device according claim 1, wherein said first item of information is the minute of the current time and the second item of information is the hour of the current time.

12. Display device according to claim 1, also comprising a display device for another time zone, the other time zone being preferably GMT.

13. Display device according to claim 12, wherein the display device of a different time zone comprises a disk bearing indications and arranged so as to be driven one turn in 24 hours, the disk being intended to be visible through an aperture formed in the dial, said display device of a different time zone also comprising a cover arranged to move between a "closed aperture" state in which the cover is superposed to a part of the disk and is visible through the aperture, and an "on-demand" state, in which the cover leaves said part of the disk visible.

14. Display device according to claim 13, wherein this display device of a different time zone comprises a correction lever adapted to modify the angular position of said disk and to move the cover into its "on-demand" state.

15. Timepiece comprising a display device according to claim 1.

16. Display device according to claim 2, wherein a return spring is arranged to exert a force tending to push the first probe towards the first cam.

* * * * *